US009062909B2

(12) United States Patent
Lu et al.

(10) Patent No.: US 9,062,909 B2
(45) Date of Patent: Jun. 23, 2015

(54) WALL-MOUNTED POINT-OF-USE AIR CHILLER FOR AIRCRAFT GALLEY CART COMPARTMENT

(75) Inventors: Qiao Lu, Placentia, CA (US); Timothy Andrew Birkmann, Corona, CA (US); Ian Oswald, Santa Ana, CA (US); Edward J. Bates, Corona, CA (US); Steven Whisler, San Juan Capistrano, CA (US); Thang Ha, Chino Hills, CA (US)

(73) Assignee: B/E AEROSPACE, INC., Wellington, FL (US)

( * ) Notice: Subject to any disclaimer, the term of this patent is extended or adjusted under 35 U.S.C. 154(b) by 1513 days.

(21) Appl. No.: 12/716,397

(22) Filed: Mar. 3, 2010

(65) Prior Publication Data

US 2010/0224726 A1 Sep. 9, 2010

Related U.S. Application Data

(60) Provisional application No. 61/157,427, filed on Mar. 4, 2009.

(51) Int. Cl.
*F25D 23/00* (2006.01)
*F25D 17/06* (2006.01)

(52) U.S. Cl.
CPC ..... *F25D 23/006* (2013.01); *F25D 17/06* (2013.01); *F25D 2317/0651* (2013.01); *F25D 2317/0665* (2013.01); *F25D 2400/20* (2013.01)

(58) Field of Classification Search
CPC ..... F25D 2400/20; F25D 23/006; F25D 2317/0665; F25D 2317/0651; F25B 27/005
USPC ..... 62/89, 244, 282, 291, 236, 387, 408, 62/465; 219/387; 29/402.01; 244/118.5
See application file for complete search history.

(56) References Cited

U.S. PATENT DOCUMENTS

| | | | | | |
|---|---|---|---|---|---|
| 3,277,956 | A * | 10/1966 | Hughes et al. | 165/64 |
| 4,075,867 | A | 2/1978 | Seipp | |
| 4,100,764 | A * | 7/1978 | Murano | 62/289 |
| 4,361,014 | A * | 11/1982 | Blain | 62/237 |
| 4,437,320 | A * | 3/1984 | Eklund | 62/236 |
| 7,231,778 | B2 * | 6/2007 | Rigney et al. | 62/407 |
| 2005/0092016 | A1 * | 5/2005 | Ozaki | 62/419 |
| 2005/0210910 | A1 | 9/2005 | Rigney et al. | |
| 2005/0235674 | A1 | 10/2005 | Ozaki et al. | |
| 2006/0210396 | A1 * | 9/2006 | Mead et al. | 415/213.1 |
| 2007/0000280 | A1 | 1/2007 | Hinder et al. | |
| 2007/0056305 | A1 * | 3/2007 | Eom et al. | 62/262 |
| 2008/0115512 | A1 * | 5/2008 | Rizzo | 62/134 |
| 2009/0044547 | A1 * | 2/2009 | Oswald | 62/89 |
| 2009/0107163 | A1 | 4/2009 | Lu et al. | |

* cited by examiner

*Primary Examiner* — Frantz Jules
*Assistant Examiner* — Emmanuel Duke
(74) *Attorney, Agent, or Firm* — Drinker Biddle & Reath LLP

(57) ABSTRACT

A point-of-use air chiller unit for an aircraft galley cart compartment is provided comprising a generally flattened rectangular case, comprising two main surfaces having a substantially larger surface area than four remaining surfaces of the case, a condenser, a compressor, an evaporator, and an evaporator fan, wherein the condenser, compressor, and evaporator are connected in a standard refrigeration manner, and a plane parallel to the main surfaces passes through the condenser, the compressor, the evaporator, and the evaporator fan.

20 Claims, 9 Drawing Sheets

WALL-MOUNTED POINT-OF-USE AIR CHILLER FOR AIRCRAFT GALLEY CART COMPARTMENT

CROSS REFERENCE TO RELATED APPLICATIONS

The present application claims the benefit of U.S. Provisional Application No. 61/157,427, filed Mar. 4, 2009, entitled, "Wall-Mounted Air Chiller for Aircraft Galley Cart Compartment", herein incorporated by reference.

BACKGROUND

The invention relates to refrigeration equipment, and more specifically to equipment for providing and re-circulating chill air to an aircraft galley food service system, and for keeping the temperature of galley food and beverages at the required food storage temperature.

Air chillers for aircraft galley food service systems are known. The existing air chillers designed for aircraft galley food service systems are installed in a remote location outside of the galley cart compartment because it has historically been difficult to locate air chillers close to galley. A further complicating factor is that galley designs are different for various aircraft configurations. Therefore, existing air chiller designs require refrigeration testing and balancing at the galley manufacturer and on first delivery for each new aircraft configuration.

Normally, an air chiller needs to service more than one galley compartment. The chiller runs whenever a single compartment requires cooling, and therefore consumes more energy than is necessary in this situation, since it is also chilling other empty compartments. Large capacity chillers are typically equipped with a powerful evaporator fan to recirculate chill air to different galley compartments, and a large amount of electrical power is needed in order to overcome the pressure loss in the air ducting system.

Known large capacity chillers produce significant air noise in chilled air outlets. The individual units are heavy, bulky, and not easy to handle. Given that there are many sizes of chillers available for different cooling requirements, airline customers typically must have many different chillers on hand in order to provide spare chillers when needed.

SUMMARY

According to various embodiments of the invention, a compact wall-mounted air chiller may be utilized that can be located inside of an aircraft galley cart compartment on its rear wall. This results in a more space saving and energy efficient chilling system for the aircraft.

According to an embodiment of the invention, a point-of-use air chiller unit for an aircraft galley cart compartment is provided, comprising: a generally flattened rectangular case, comprising two main surfaces having a substantially larger surface area than four remaining surfaces of the case; a condenser; a compressor; an evaporator; and an evaporator fan; wherein the condenser, compressor, and evaporator are connected in a standard refrigeration manner; and a plane parallel to the main surfaces passes through the condenser, the compressor, the evaporator, and the evaporator fan.

Furthermore, an aircraft galley cart may be provided comprising: a cart outer case having a rear and side walls; a cart vent assembly comprising cart vents; a point-of-use air chiller unit as described above mounted on the rear wall of the cart; and upper and lower ducts that are respectively connected on one end to the chiller unit for air supply and return air, and connected on an other end to the cart vent assembly.

BRIEF DESCRIPTION OF THE DRAWINGS

The invention will be explained in more detail below with reference to various embodiments of the invention as illustrated in the drawings.

DESCRIPTION OF THE PREFERRED EMBODIMENTS

Figure 1B:
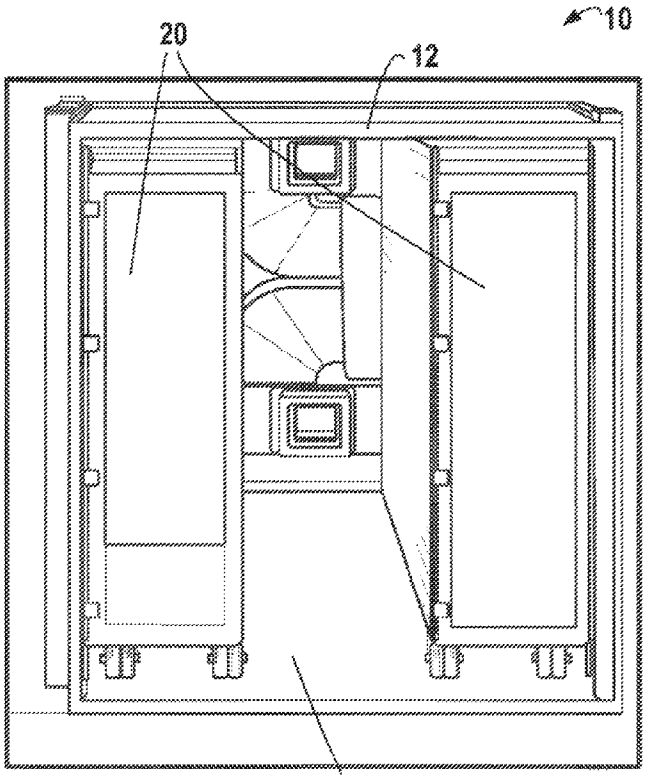
FIGS. 1A and 1B are front views of the chiller system installed within a galley cart compartment area.
Figure 1A:
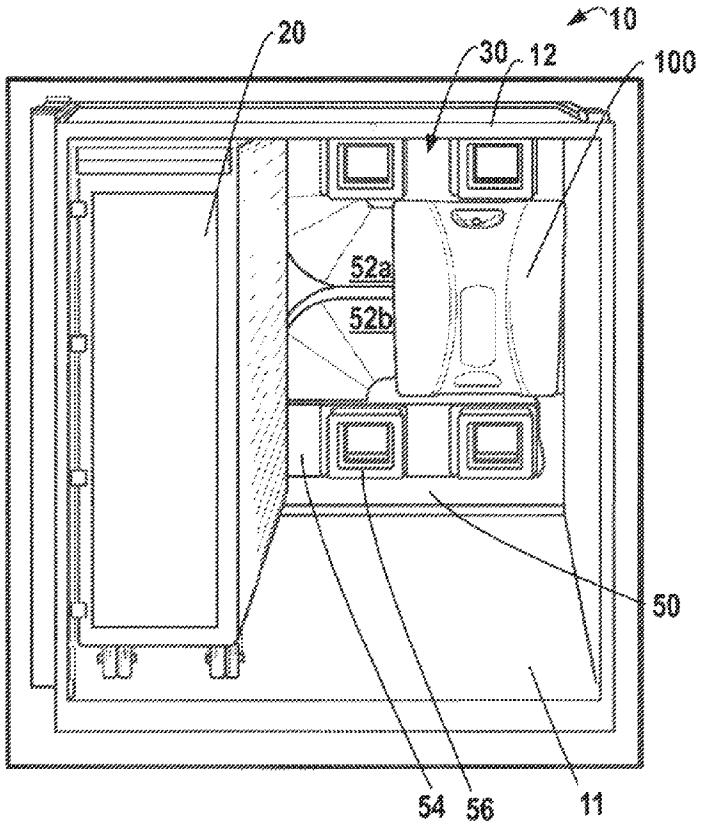

FIGS. 1A and 1B illustrate an embodiment of an aircraft galley food services system 10 that uses a galley cart compartment 11 for holding one or more galley food carts 20 in an enclosure area bounded by an outer case 12. Such food carts 20 are moved down the aisles of aircraft in order to serve meals and beverages.

In a typical configuration, such a galley compartment 11 is designed to hold a maximum of three carts 20, but such a compartment could be designed to accommodate any number of such carts 20. FIG. 1A shows a single cart 20 within the cart compartment 11, and FIG. 1B shows the compartment 11 with two carts 20.

An embodiment of the inventive air chiller system 30 can be seen mounted at the rear of the cart compartment 11. The chiller system 30 comprises the following main components that are described in more detail below. An air chiller unit 100 comprises the actual refrigeration components, and circulates chilled air via, e.g., an upper duct 52*a* (used, e.g., for a chilled air supply) and a lower duct 52*b* (e.g., used for an air return). Each of these ducts 52*a, b*, are connected to a cart vent assembly 54 that each comprise a plurality of cart vents 56 that may comprise an interface boot. Each cart 20 may have two corresponding vents (not shown) that interface with a corresponding pair of cart vents 56 on the cart vent assemblies 54 fed by the respective ducts 52*a, b*. In this way, each cart 20 is connected with a chilled air supply and an air return.

Figure 2:
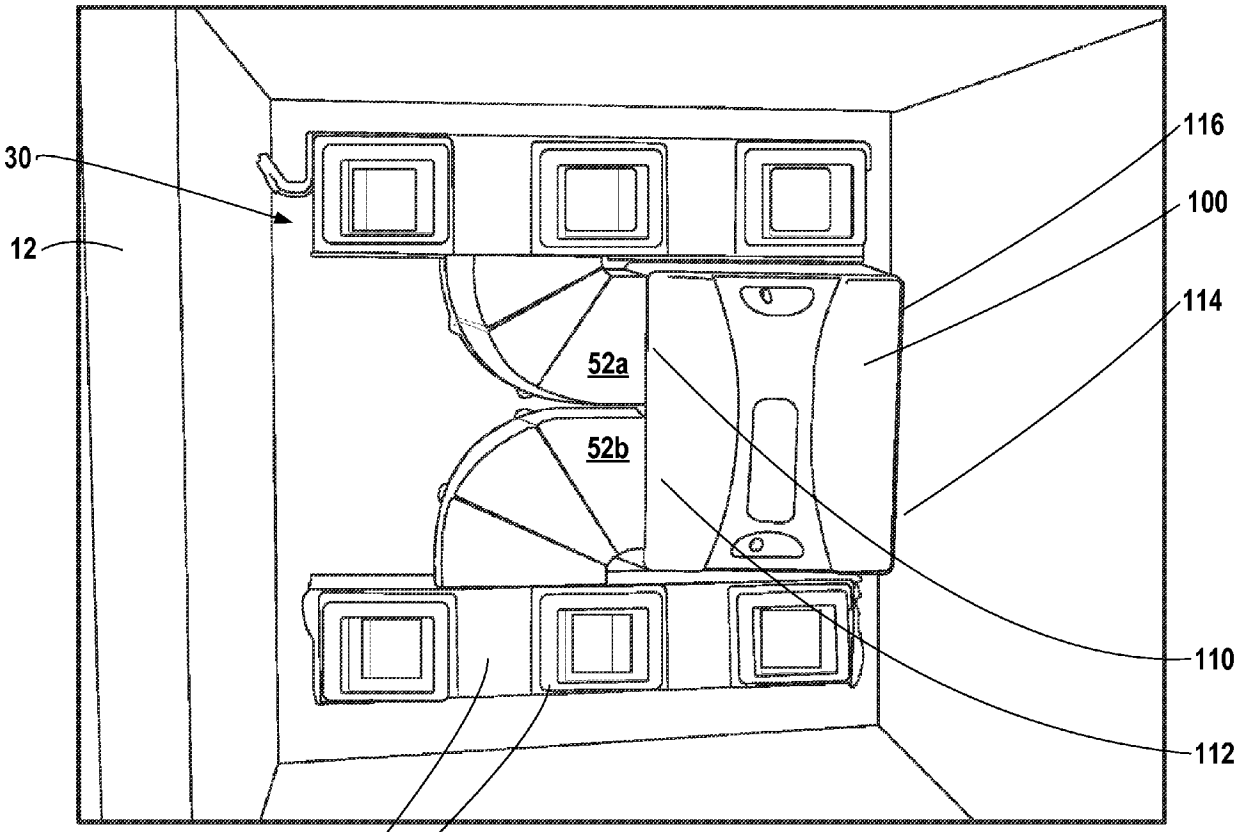
FIG. 2 is a front view of the chiller system installed within the galley cart compartment area with the carts removed.

FIG. 2 shows the positioning of the air chiller system 30 within the space of the galley cart compartment 11 in more detail. In this embodiment, the chiller system 30 is affixed to a rear and/or side wall of the cart compartment 11. The width of the chiller system 30 is such that the cart compartment can accommodate both the chiller system 30 along with any carts 20 that are provided. Any know mechanisms may be used to mount the chiller system 30 within the cart compartment 11. As will be discussed in more detail below, the condenser supply 114 and condenser exhaust 116 are interfaced with cutouts in a side wall of the cart compartment 11.

Figure 3B:
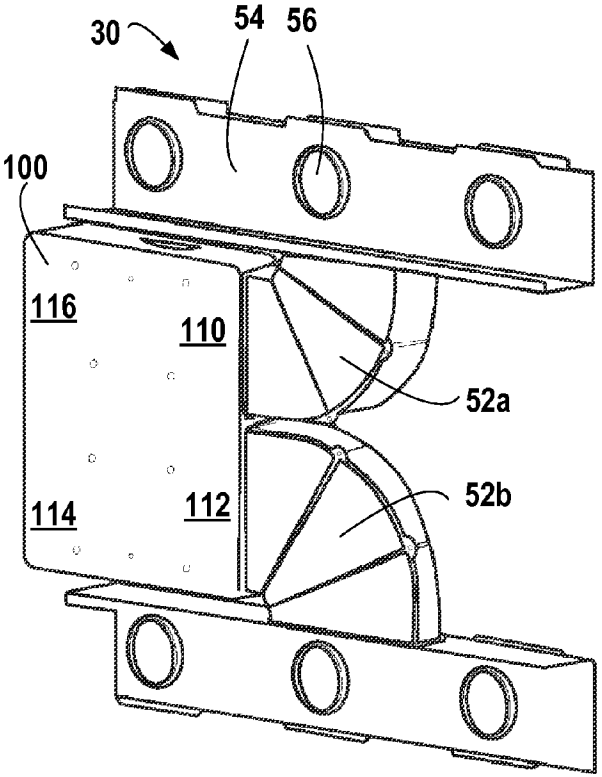
FIGS. 3A and 3B are perspective front and perspective rear views of a mounted air chiller system.
Figure 3A:
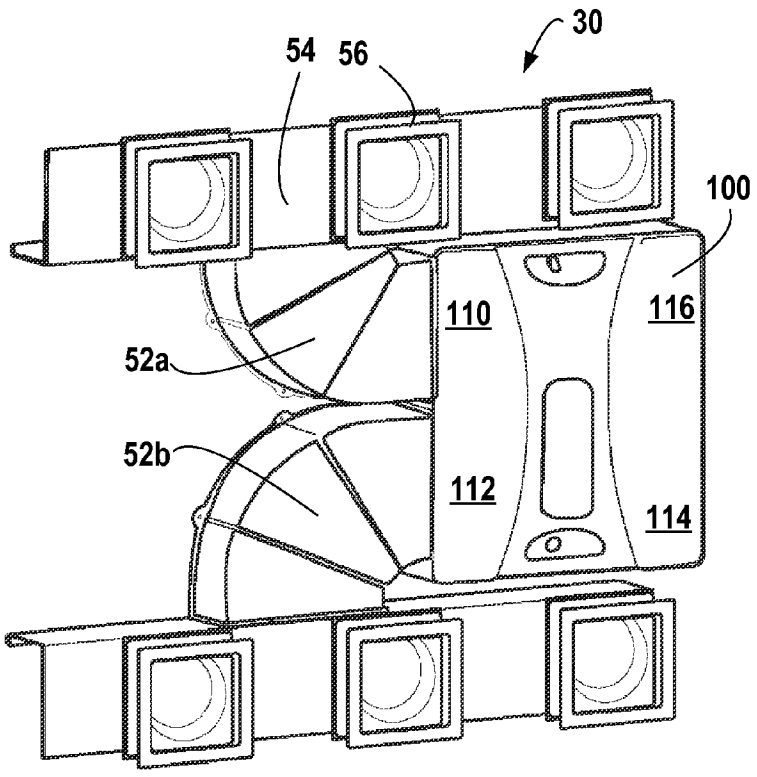

FIGS. 3A and 3B are front and rear perspective illustrations of the air chiller system 30 separated from the cart compartment 11. In these views, the air chiller unit 100 that provides the chilled air can be seen connected to the upper and lower ducts 52*a*, 52*b*, that feed respective cart vent assemblies with cart vent boots/vents 56. A chilled supply air vent 110 is connected to the upper duct 52*a*, and a return air vent 112 is connected to the lower duct.

FIGS. 4A-4D illustrate the air chiller unit 100 in a number of views without any of the ductwork. The unit 100 is enclosed with a suitable case 102.

Figure 4A:
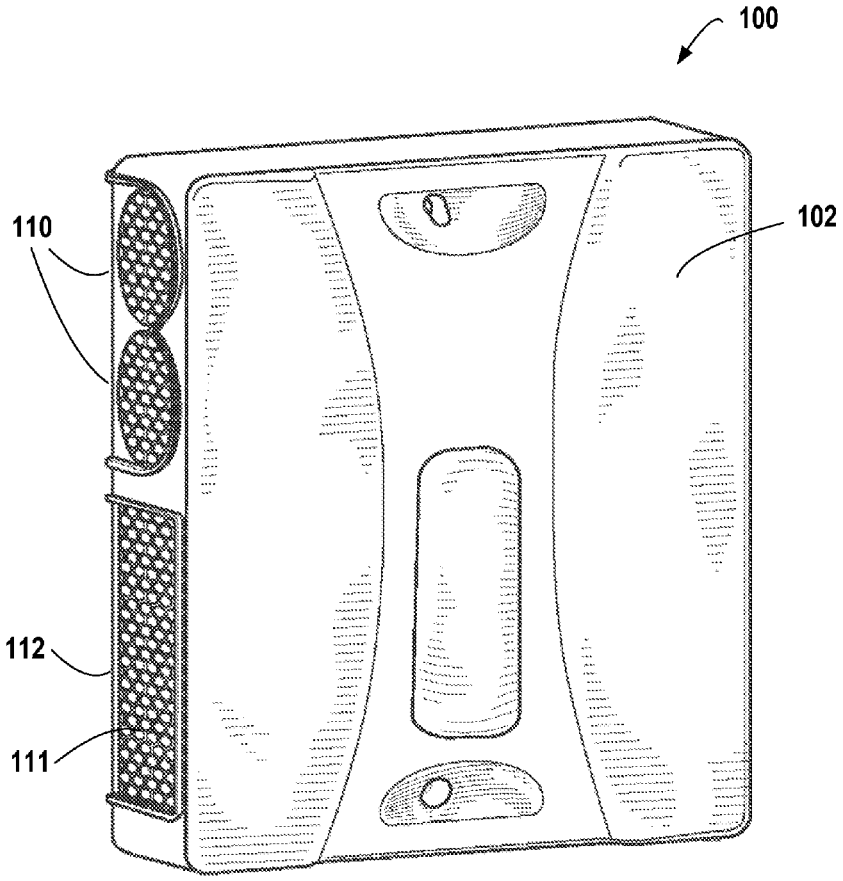
FIG. 4A is a perspective view of the compact air chiller unit according to an embodiment of the invention.
Figure 4B:
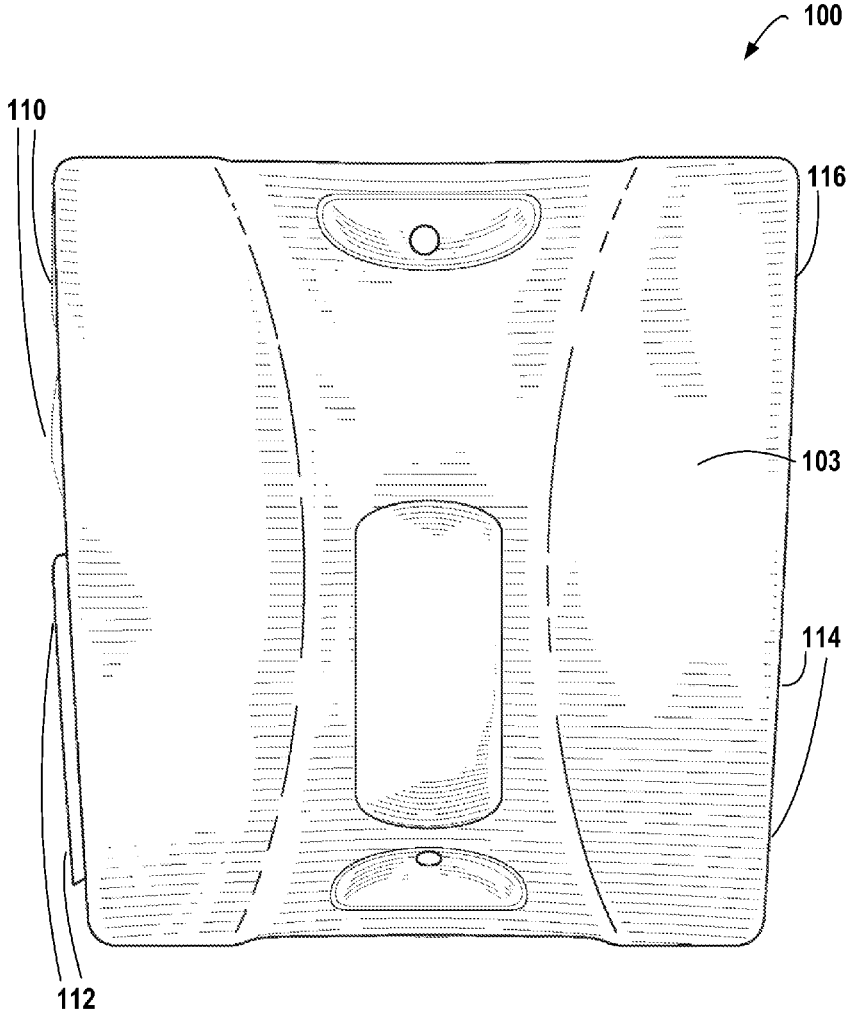
FIG. 4B is a side view of the compact air chiller unit.
Figure 4D:
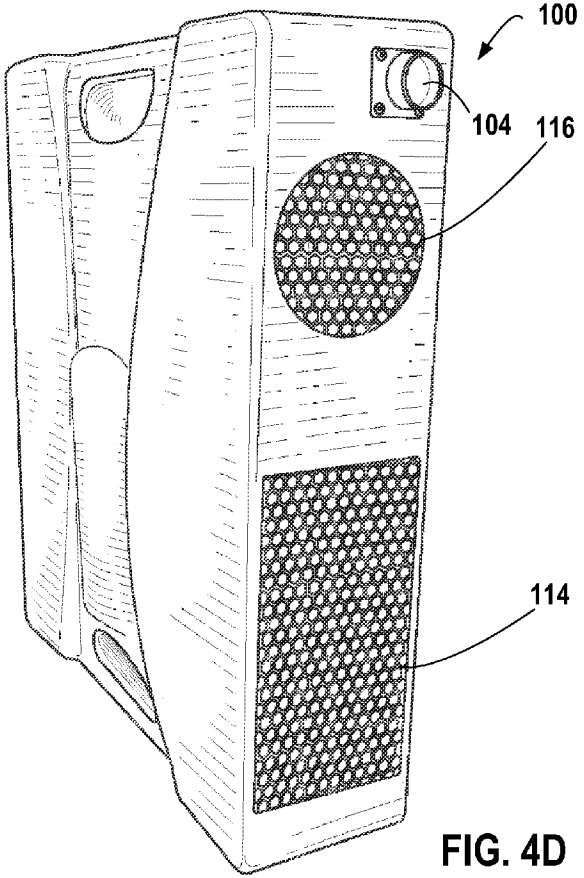
FIGS. 4C and 4D are perspective views of the chiller showing the air flow locations on the unit.
Figure 4C:
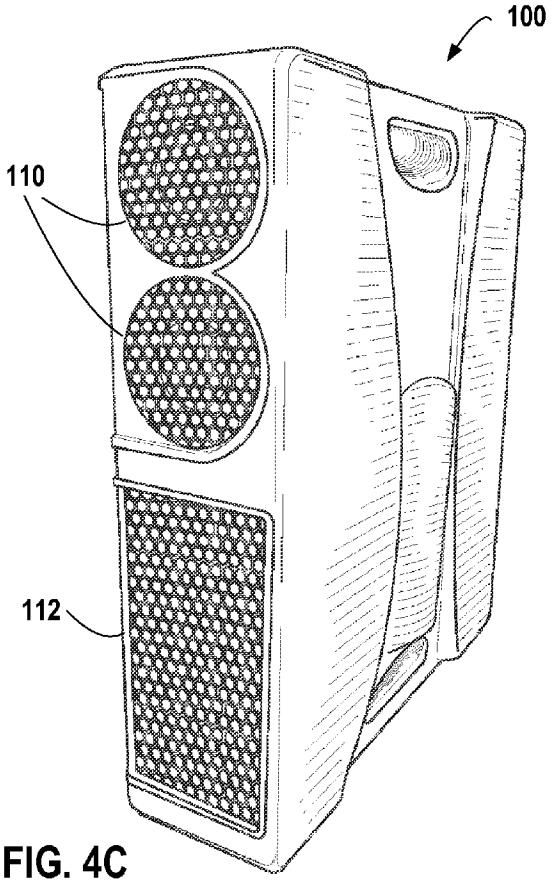

FIG. 4A shows the chilled supply air vents 110 and the return air vent 112, covered with a filter 111. The filters may be provided to ensure that contaminants do not enter the chiller unit 100. FIG. 4B is a side view showing both the supply air 110 and return air 112 vents. It also shows the condenser supply 114 and condenser exhaust 116. FIGS. 4C and 4D are perspective views of the air chiller unit 100.

Figure 5:
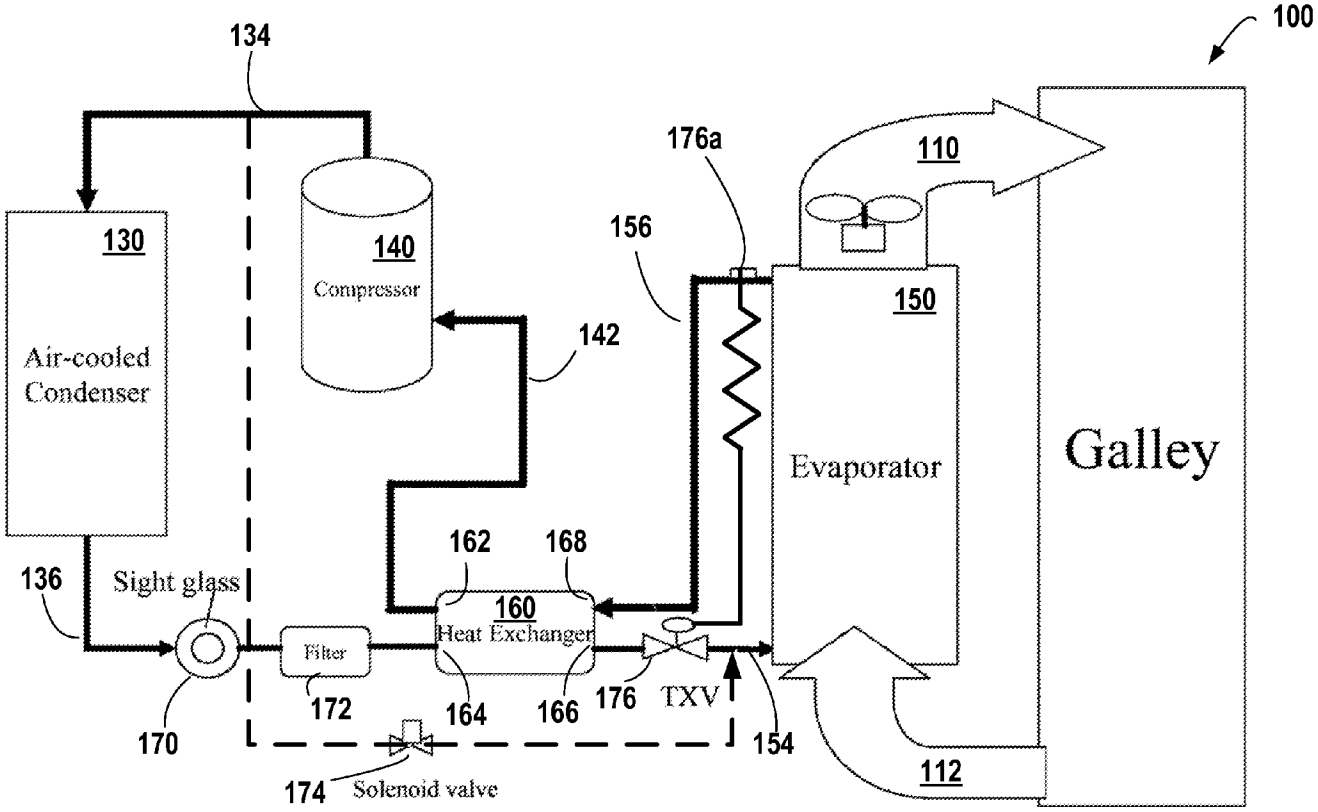
FIG. 5 is a block diagram illustrating the aircraft cooling system.

FIG. 5 is a basic block diagram of the air chiller unit 100. Starting at the compressor 140, the refrigerant is compressed and sent out of the compressor as a high temperature, high pressure, and superheated vapor.

The refrigerant travels from Line 134 to an air-cooled condenser 130 where heat is rejected to a secondary air circuit by a condenser fan. The condenser changes the refrigerant from a high temperature and high pressure vapor to a high pressure sub cooled liquid.

The refrigerant then travels from Line 136 into refrigerant liquid sight glass 170 and filter-drier 172 where the flow of liquid refrigerant can be monitored and the moisture and solid contaminants and debris are strained out of the refrigerant. It then moves through a vapor to liquid heat exchanger 160, from inlet 164 to outlet 166 where the liquid refrigerant is further sub-cooled by a vapor refrigerant from evaporator.

The refrigerant continues to the Thermal Expansion Valve or TXV 176. The TXV 176 controls the quantity of liquid refrigerant being fed into the evaporator 150. The TXV 176 causes the pressure of liquid refrigerant to be reduced. The TXV 176 regulates the quantity of refrigerant through the evaporator to maintain a preset temperature difference or superheat between the evaporating refrigerant and the vapor leaving the evaporator 150. As the temperature of the gas leaving the evaporator varies, the expansion valve temperature sensing bulb 176*a*, which is clamped to the outlet tube of evaporator, senses this temperature, and acts to modulate the feed of refrigerant through the TXV 176.

The low temperature and low pressure refrigerant enters the evaporator 150, heat flow from galley cooing equipment and/or avionics equipment through the walls of the evaporator into the refrigerant. The boiling process of refrigerant continues until the refrigerant is completely evaporated.

The superheated refrigerant vapor leaving the evaporator 150 travels into the vapor to liquid heat exchanger 160 where the vapor refrigerant is superheated further by the liquid refrigerant. It continues to the compressor suction line 142. The compressor 140 takes this superheated low pressure vapor and compresses it. The refrigerating cycle is continuous as long as the compressor is operating.

The hot gas by pass solenoid valve or defrost valve 174 is used to stabilize refrigeration system at compressor starting, and to control the cooling output of the refrigeration system by allowing hot gas to warm up the cool evaporator. This causes a reduction in to cooling efficiency and a stabilizing of the chilled air temperatures.

The refrigeration cycle results in frost formation on the surface of the evaporator. This frost will eventually build up to the point where it will restrict the air flow causing a loss of refrigeration capacity. To prevent this, the defrost valve will be energized or opened to initiates a defrost cycle which melts the frost. Once all of the frost has melted and the moisture has drained away. The system will then resume back to the refrigeration cycle.

Figure 6A:
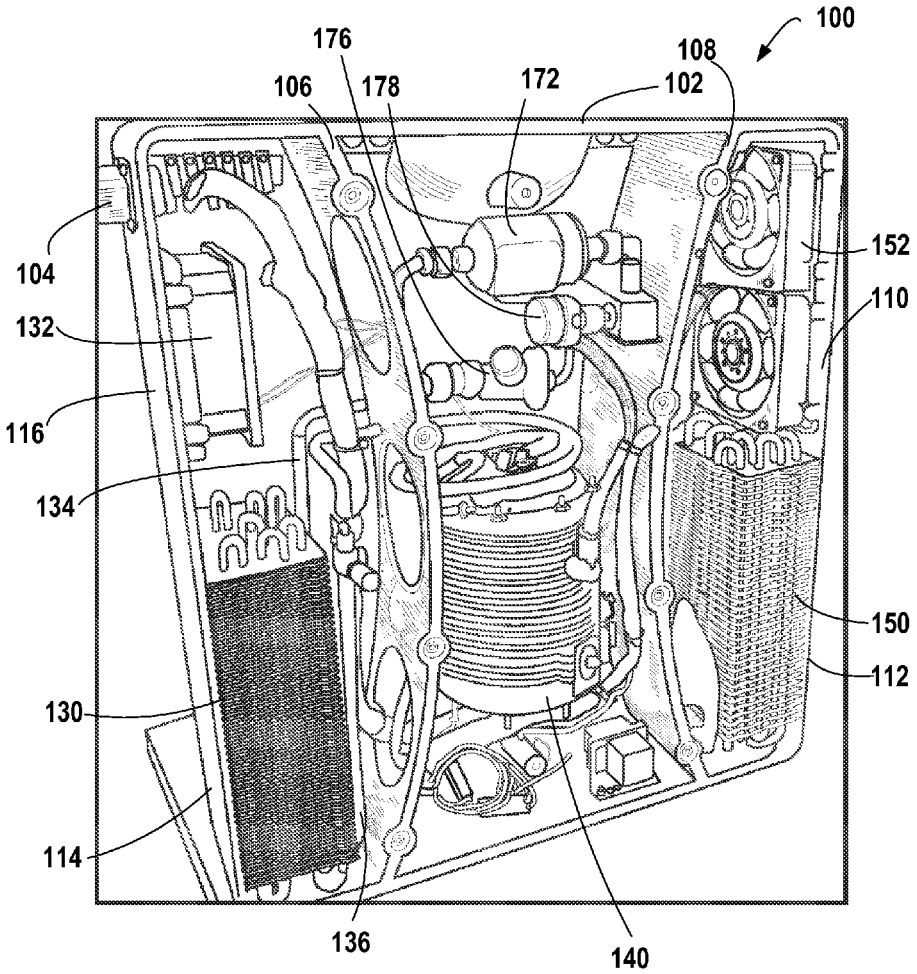
FIG. 6A is a perspective view of the chiller with cover removed showing the interior components.
Figure 6C:
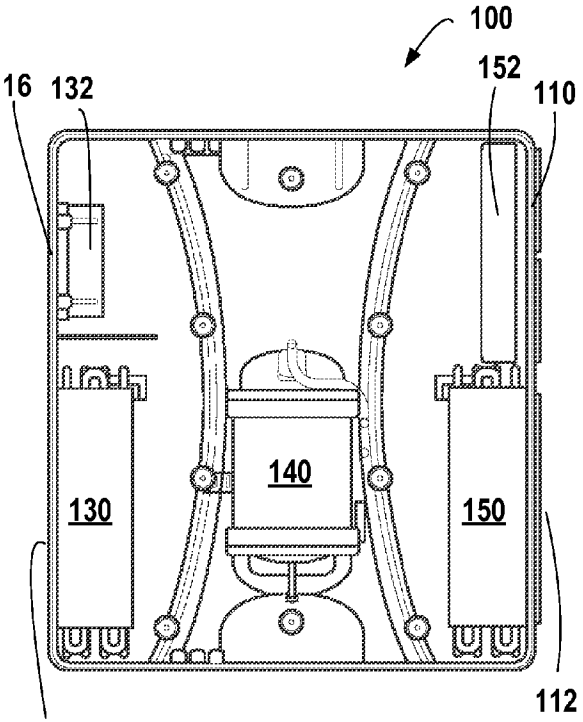
FIG. 6C is a front view of the interior components.
Figure 6B:
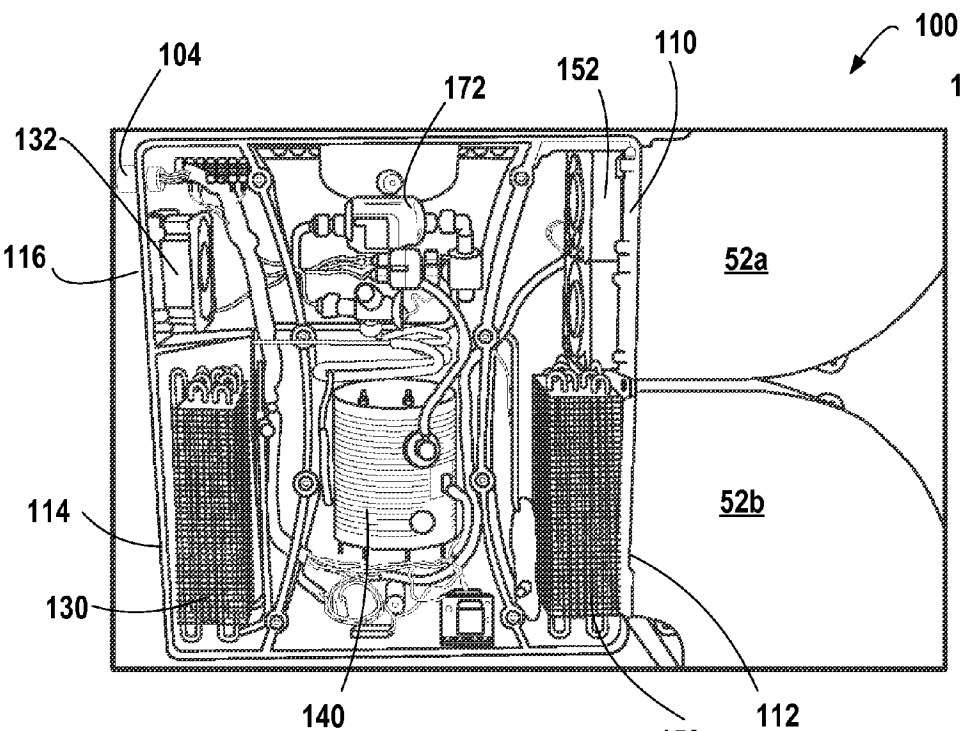
FIG. 6B is a front view of the chiller with cover removed and showing the attached duct work.

FIGS. 6A-6C show an exemplary placement of the chiller unit 100 components. The chiller unit 100 as a whole preferably has a flattened rectangular block shape in which all of the components are sized and mounted to fit within this bounded region enclosed by the case 102. In a preferred embodiment, the chiller unit 100 has a width of approximately 24", a height of approximately 20", and a depth of approximately 4".

The chiller unit 100 has two main surfaces 103 each comprising a substantially greater area than the remaining four surfaces, where one of the greater area surfaces is designed to be adjacent to a back wall of the galley cart compartment. The layout of the components is in a generally flattened configuration such that a plane parallel to the main surfaces cuts through the condenser 130, the condenser fan 132, the compressor 140, the evaporator 150, and the evaporator fan 152.

In this embodiment, the condenser 130 is located in a lower bottom left corner (according to the FIG. 6A view) of the chiller unit 100. Ambient air is pulled through the condenser 130 via a vacuum created by the condenser fan 132, located above the condenser 130 and connected adjacent to the condenser exhaust 116, which vents heated air into other parts of the aircraft outside of the galley cart compartment 11. This causes the heated pressurized refrigerant to condense into a liquid.

The compressor 140 is located in a lower central region of the air chiller unit 100. The control circuitry, valves 174, 176, safety switches 178, and the like are located primarily above the compressor 140, which are situated in a compartment bounded by a first unsealed case partition 106 that permits heat created by the compressor 140 and associated components to be exhausted out of the condenser exhaust 116 via the condenser fan 132. The compressor 140 is also bounded by a generally second sealed case partition 108 that isolates the evaporator 150 and evaporator fans 152 to prevent heat generated within the unit 100 to not enter the galley cart compartment 11.

In a preferred embodiment, the chiller unit 100 meets the following table of performance requirements:

TABLE 1

| POU Performance Requirements | | | | | |
|---|---|---|---|---|---|
| | | IP Unit | | SI Unit | |
| | | | POU-A3 | | POU-A3 |
| Air-Cooling Processes | | | | | |
| Ambient Temperature | Air | ° F. | 85 | ° C. | 29.4 |
| Chiller return air temperature | Air | ° F. | 39.2 | ° C. | 4.0 |

TABLE 1-continued

| POU Performance Requirements | | | | | |
|---|---|---|---|---|---|
| | | IP Unit | | SI Unit | |
| | | | POU-A3 | | POU-A3 |
| Chiller supply air temperature | Air | ° F. | 30 | ° C. | −1.1 |
| Moisture content | Air | % | 85 | % | 85.0 |
| Evaporator air flow | Air | CFM | 202 | Liter/Sec | 95.3 |
| Evaporator fan pressure drop | Air | inH2O | 1 | mbar | 2.5 |
| Cooling capacity of chiller | Air | Btu/h | 2150 | w | 629.7 |
| Refrigeration System | | | | | |
| Evaporating pressure | Refrigerant | Psia | 31.8 | Bar | 2.2 |
| Evaporating temperature | Refrigerant | ° F. | 18.1 | ° C. | −7.7 |
| Cooling capacity | Refrigerant | Btu/h | 2266 | w | 663.7 |
| Condensing pressure | Refrigerant | Psia | 185.9 | Bar | 12.8 |
| Condensing temperature | Refrigerant | ° F. | 120 | ° C. | 48.9 |
| Condenser air flow | Air | CFM | 135 | Liter/Sec | 63.7 |
| Condenser fan pressure drop | Air | inH2O | 0.50 | mbar | 1.2 |
| Condenser heat rejection | Refrigerant | Btu/h | 3714 | w | 1087.7 |
| Chiller discharge air temperature | Air | ° F. | 120.6 | ° C. | 49.2 |
| Power and COP | | | | | |
| Evaporator fan | Air | w | 67.8 | w | 67.8 |
| Condenser Fan | Air | w | 22.7 | w | 22.7 |
| Compressor | Refrigerant | w | 593 | w | 593 |
| Liquid | pump | PGW | w | w | 0 |
| Total Power Consumption | | w | 683.5 | w | 683.5 |
| COP | | | 0.92 | | 0.92 |

Thus, what is provided is an air chiller system 30 that is a compact space and weight saving unit that is designed to maximize cooling capacity for up to, e.g., four trolley carts in an aircraft galley food service system 10. Due to its thin (shallow depth) design, it fits behind traditional galley cart ducting for a chilled galley compartment. Due to its close proximity to the galley carts, it eliminates the long chilled air supply ducts typically associated with remotely mounted air chiller units.

The light-weight (approximately 20 lbs.) compact design for this embodiment maximizes cooling capacity in a small space and represents a weight savings over traditional equivalently performing 40 lb. units. Additional weight savings for a typical installation of this unit is gained from the absence of long duct runs, long electrical cable runs, and heavy mounting structures normally associated with remote-mounted air chilling units. The unit is preferably designed to use less than 700 watts of power.

In other embodiments of the compact air chiller system 30, air may be exhausted upward, or downward. In further embodiments, the compact air chiller unit 100 is capable of a reverse mount, such that the supply air and the return air may be received/sent to the other side. This allows for flexible installations and galley ducting locations. In still another embodiment, the condenser air fan 132 may be mounted in a remote location, upstream in the exhaust duct to reduce, minimize, or eliminate condenser air noise. Baffling techniques may also be used to eliminate condenser air noise.

In sum, the compact air chillers are designed for a chilled compartment galley wall mount, have flexible reversible mounting capabilities, provide for multiple cart cooling configurations (e.g., for one to four carts), and can have reversible fans for optimized cooling load balance.

For the purposes of promoting an understanding of the principles of the invention, reference has been made to the preferred embodiments illustrated in the drawings, and specific language has been used to describe these embodiments. However, no limitation of the scope of the invention is intended by this specific language, and the invention should be construed to encompass all embodiments that would normally occur to one of ordinary skill in the art.

The present invention may be described in terms of functional block components and various processing steps. Such functional blocks may be realized by any number of components configured to perform the specified functions. Furthermore, the present invention could employ any number of conventional techniques for electronics configuration, control and the like.

The particular implementations shown and described herein are illustrative examples of the invention and are not intended to otherwise limit the scope of the invention in any way. For the sake of brevity, conventional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical".

The use of the terms "a" and "an" and "the" and similar referents in the context of describing the invention (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Finally, the steps of all methods described herein can be performed in any suitable order unless otherwise indicated herein or otherwise clearly contradicted by context.

The words "mechanism" and "element" are intended to be used generally and are not limited solely to mechanical embodiments. Numerous modifications and adaptations will be readily apparent to those skilled in this art without departing from the spirit and scope of the present invention.

TABLE OF REFERENCE CHARACTERS

| | |
|---|---|
| 10 | aircraft galley food services system |
| 11 | galley cart compartment |
| 12 | cart compartment outer case |
| 20 | galley food cart |
| 30 | air chiller system |
| 50 | vent assembly |
| 52a | upper duct |
| 52b | lower duct |
| 54 | cart vent assembly |
| 56 | cart vent boots/cart vents |
| 100 | air chiller unit |
| 102 | case |
| 103 | case main surface |
| 104 | power connection |
| 106 | unsealed case partition |
| 108 | sealed case partition |
| 110 | chilled supply air vent |
| 111 | filter |
| 112 | return air vent |
| 114 | condenser supply |
| 116 | condenser exhaust |
| 130 | condenser |
| 132 | condenser fan |
| 134 | condenser input line |
| 136 | condenser output line |
| 140 | compressor |
| 142 | compressor input line |
| 150 | evaporator |
| 152 | evaporator fan |
| 154 | evaporator input line |
| 156 | evaporator output line |
| 160 | heat exchanger |
| 162 | compressor output |
| 164 | condenser input |
| 166 | evaporator output |
| 168 | evaporator input |
| 170 | sight glass |
| 172 | filter/drier |
| 174 | solenoid valve |
| 176 | thermal expansion valve (TXV) |
| 176a | temperature sensing bulb |
| 178 | pressure safety switch |

What is claimed is:

1. A point-of-use air chiller unit for an aircraft galley cart compartment, comprising: a generally flattened rectangular case, comprising two main surfaces having a larger surface area than four remaining surfaces of the case; an air-cooled condenser; a compressor; an evaporator; and an evaporator fan; a first unsealed wall partition within the case that separates the condenser from the compressor; and a second generally sealed wall partition within the case that separates the evaporator from the compressor and condenser; wherein: the condenser, compressor, and evaporator are connected in a standard refrigeration manner; the condenser, compressor, and evaporator are disposed within an interior of the generally flattened rectangular case; wherein: the first unsealed wall partition extends to contact both main surfaces and two parallel surfaces of the case perpendicular to the main surfaces; and the second generally sealed wall partition extends to contact both main surfaces and two parallel surfaces of the case perpendicular to the main surfaces; and wherein: the first unsealed wall partition and the second generally sealed wall partition have a contiguous and continuous arched shape for their entire length; and a plane parallel to the main surfaces passes through the condenser, the compressor, the evaporator, and the evaporator fan.

2. The chiller according to claim 1, wherein:

the condenser is located in a lower portion of one side of the rectangular case;

the evaporator is located in a lower portion of an opposite side of the rectangular case; and the compressor is located in between the condenser and the evaporator.

3. The chiller according to claim 1, wherein the chiller weighs approximately 20 pounds and is sized to fit within a food galley cart compartment.

4. The chiller according to claim 1, wherein the total power consumption is less than 700 watts.

5. The chiller according to claim 1, further comprising a condenser fan.

6. The chiller according to claim 5, wherein the condenser fan is located within the case.

7. The chiller according to claim 1, further comprising valves and safety switches to control pressure in refrigeration lines.

8. The chiller according to claim 1, wherein one or more of the fans are reversible.

9. An aircraft galley cart comprising:

a cart outer case having a rear and side walls;

a cart vent assembly comprising cart vents;

the point-of-use air chiller unit as claimed in claim 1, mounted at the rear wall of the cart;

upper and lower ducts that are respectively connected on one end to the chiller unit for air supply and return air, and connected on an other end opposite the one end to the cart vent assembly.

10. The chiller according to claim 1, further comprising a condenser air supply and a condenser air exhaust interfaced with cutouts in a side wall of the galley cart compartment.

11. The chiller according to claim 1, further comprising a condenser air exhaust duct external to the case and a condenser air fan remotely mounted upstream in the exhaust duct.

12. The chiller according to claim 1, further comprising a vapor to liquid heat exchanger which exchanges heat between liquid refrigerant after exiting the condenser and vapor refrigerant after exiting the evaporator to sub-cool the liquid refrigerant and superheat the vapor refrigerant.

13. The chiller according to claim 1, further comprising a defrost valve which initiates a defrost cycle to melt frost formed on a surface of the evaporator.

14. The chiller according to claim 1, wherein the generally flattened rectangular case has a depth of approximately 4 inches.

15. The chiller according to claim 1, further comprising:

a first duct assembly comprising a plurality of chilled air cart vents, each chilled air cart vent interfaceable with a corresponding aircraft galley cart such that the evaporator fan supplies chilled air from the evaporator to the cart via the first duct assembly; and a second duct assembly comprising a plurality of return air cart vents, each return air cart vent interfaceable with a corresponding aircraft galley cart such that the evaporator fan pulls return air from the cart to the case via the second duct assembly;

wherein the case is mounted at a wall of an aircraft galley cart compartment, and the plane parallel to the main surfaces also passes through the first duct assembly and the second duct assembly.

16. The chiller according to claim 15 wherein the chiller is reversibly mounted such that the evaporator fan selectively supplies chilled air from the evaporator to the cart via one of the first duct assembly and the second duct assembly and pulls return air from the cart to the case via the other of the first duct assembly and the second duct assembly, depending upon the mounting of the chiller.

17. An aircraft galley cart comprising:

a point-of-use air chiller unit as claimed in claim 16;

a cart outer case having a rear and side walls;

a first vent removably coupled with a corresponding chilled air cart vent of the first duct assembly; and a second vent removably coupled with a corresponding return air cart vent of the second duct assembly.

18. The chiller according to claim 1, wherein a ratio of a depth to another dimension of the case is a minimum of 1:5.

19. The chiller according to claim 1, wherein the first unsealed wall partition and the second generally sealed wall partition have an overall arched shape.

20. The chiller according to claim 1, wherein:

the first unsealed wall partition permits heat created by the compressor to be exhausted out of a condenser exhaust via a condenser fan; and the second generally sealed case portion isolates the evaporator and the evaporator fan to prevent heat generated within the unit from entering a galley cart compartment.

* * * * *